US010381765B2

(12) United States Patent
Hotta et al.

(10) Patent No.: US 10,381,765 B2
(45) Date of Patent: Aug. 13, 2019

(54) FEMALE CONTACT AND MATING STRUCTURE OF CONTACTS

(71) Applicants: Tyco Electronics Japan G.K., Kanagawa (JP); Toyota Jidosha Kabushiki Kaisha, Aichi-ken (JP)

(72) Inventors: Daiji Hotta, Kanagawa (JP); Seiji Komatsu, Kanagawa (JP); Masahiro Imanishi, Aichi-ken (JP)

(73) Assignees: Tyco Electronics Japan G.K., Kanagawa (JP); Toyota Jidosha Kabushiki Kaisha, Aichi-ken (JP)

( * ) Notice: Subject to any disclaimer, the term of this patent is extended or adjusted under 35 U.S.C. 154(b) by 3 days.

(21) Appl. No.: 15/889,682

(22) Filed: Feb. 6, 2018

(65) Prior Publication Data

US 2018/0233843 A1 Aug. 16, 2018

(30) Foreign Application Priority Data

Feb. 10, 2017 (JP) ..... 2017-22679

(51) Int. Cl.
*H01R 13/11* (2006.01)
*H01R 13/04* (2006.01)
(Continued)

(52) U.S. Cl.
CPC ..... *H01R 13/112* (2013.01); *H01R 13/04* (2013.01); *H01R 13/113* (2013.01); *H01R 13/193* (2013.01); *H01R 13/20* (2013.01)

(58) Field of Classification Search
CPC .... H01R 13/112; H01R 13/113; H01R 13/04; H01R 13/193; H01R 13/20
(Continued)

(56) References Cited

U.S. PATENT DOCUMENTS 3,823,392 A * 7/1974 Pfeifer ..... H01R 13/112 439/856
5,658,174 A * 8/1997 Benes ..... H01R 13/187 439/842
(Continued)

FOREIGN PATENT DOCUMENTS

DE 3110609 A1 10/1982
EP 0724783 B1 8/1997
(Continued)

OTHER PUBLICATIONS

Abstract of DE3110609A1, dated Oct. 7, 1982, 1 page.
(Continued)

*Primary Examiner* — Abdullah A Riyami
*Assistant Examiner* — Nelson R. Burgos-Guntin
(74) *Attorney, Agent, or Firm* — Barley Snyder

(57) ABSTRACT

A female contact and a mating structure in which the female contact mates with a male contact. The female contact has first and second elastic arms that are connected together. The first elastic arm has a first dummy contact point and a first actual contact point rearward of the first dummy contact point and has a smaller protrusion than the first dummy contact point. The second elastic arm has a second dummy contact point and a second actual contact point rearward of the second dummy contact point and has a smaller protrusion amount than the second dummy contact point.

20 Claims, 6 Drawing Sheets

(51) Int. Cl.
*H01R 13/193* (2006.01)
*H01R 13/20* (2006.01)

(58) Field of Classification Search
USPC ..... 439/346, 347, 866, 885, 246, 252, 842, 439/852, 850, 877, 834
See application file for complete search history.

(56) References Cited

U.S. PATENT DOCUMENTS 5,897,405 A * 4/1999 Endo ..... H01R 13/11 439/852
6,186,810 B1 * 2/2001 Barnabe ..... H01R 13/187 439/252
6,299,489 B1 * 10/2001 Phillips ..... H01R 13/111 439/252
6,315,591 B2 * 11/2001 Oda ..... H01R 13/18 439/246
6,338,638 B2 * 1/2002 Kodama ..... H01R 13/11 439/246
6,439,935 B2 * 8/2002 Saka ..... H01R 13/113 439/842
6,447,345 B2 * 9/2002 Sato ..... H01R 43/16 439/842
6,585,544 B2 * 7/2003 Furutani ..... H01R 13/113 439/252
6,616,459 B2 * 9/2003 Norris ..... H01R 12/585 439/751
6,736,684 B2 * 5/2004 Ishiyama ..... H01R 13/187 439/852
6,755,697 B2 * 6/2004 Kojima ..... H01R 13/114 439/595
6,971,927 B2 * 12/2005 Anbo ..... H01R 13/113 439/852
7,048,582 B2 * 5/2006 Tabata ..... H01R 13/113 439/595
7,144,281 B2 * 12/2006 Maeda ..... H01R 13/113 439/852
7,156,704 B2 * 1/2007 Shimizu ..... H01R 13/113 439/852
7,179,138 B2 * 2/2007 Nora ..... H01R 13/422 439/843
7,300,319 B2 * 11/2007 Lutsch ..... H01R 4/185 439/845
8,974,256 B2 * 3/2015 Okano ..... H01R 13/113 439/852
9,011,186 B2 * 4/2015 Wirth ..... H01R 13/112 439/843
9,130,282 B2 * 9/2015 Suzuki ..... H01R 4/185
9,570,854 B2 * 2/2017 Hashimoto ..... H01R 13/113
9,601,854 B2 * 3/2017 Kutsuna ..... H01R 13/11
2003/0220015 A1 * 11/2003 Ishiyama ..... H01R 13/187 439/595
2006/0035538 A1 * 2/2006 Suemitsu ..... H01R 13/113 439/852
2008/0009170 A1 * 1/2008 Kato ..... H01R 13/193 439/347
2008/0280510 A1 * 11/2008 Moll ..... H01R 4/185 439/877
2009/0011631 A1 * 1/2009 Yoo ..... G02F 1/133604 439/346
2010/0297866 A1 * 11/2010 Ju ..... H01R 13/112 439/342
2011/0086557 A1 * 4/2011 Kubota ..... H01R 13/113 439/842
2012/0083171 A1 * 4/2012 Byrne ..... H01R 4/48 439/888
2012/0142233 A1 * 6/2012 Blasko ..... H01R 13/113 439/852
2012/0214360 A1 * 8/2012 Kumakura ..... H01R 4/04 439/878
2012/0329341 A1 * 12/2012 Morikawa ..... H01R 4/185 439/866
2013/0288546 A1 * 10/2013 Okano ..... H01R 13/11 439/852
2014/0287621 A1 * 9/2014 Smutny ..... H01R 31/08 439/574
2015/0050838 A1 * 2/2015 Copper ..... H01R 13/114 439/626
2015/0222038 A1 * 8/2015 Volpone ..... H01R 13/113 439/842
2016/0118745 A1 * 4/2016 Droesbeke ..... H01R 13/4368 385/76
2016/0359251 A1 * 12/2016 Droesbeke ..... H01R 13/113
2018/0233843 A1 * 8/2018 Hotta ..... H01R 13/113

FOREIGN PATENT DOCUMENTS

EP 2528166 A1 11/2012
GB 1102935 A 2/1968
GB 2009529 A 6/1979
JP S62-229676 A 10/1987
JP 686268 U 12/1994
JP 2001210436 A 8/2001
JP 2003-317843 A 11/2003

OTHER PUBLICATIONS

Abstract of EP2528166A1, dated Nov. 28, 2012, 1 page.
Extended European Search Report, EP 18154970.0, dated Jun. 15, 2018, 10 pages.
Japanese Notification of Reasons for Refusal, dated Nov. 19, 2018, 7 pages.

* cited by examiner

FEMALE CONTACT AND MATING STRUCTURE OF CONTACTS

CROSS-REFERENCE TO RELATED APPLICATION

This application claims the benefit of the filing date under 35 U.S.C. § 119(a)-(d) of Japanese Patent Application No. 2017-22679 filed Feb. 10, 2017.

FIELD OF THE INVENTION

The present invention relates, in general, to a female contact that is mated with a plate-like male contact by sandwiching the male contact, and, in particular, to a female contact that reduces abrasion of a contact point by the male contact.

BACKGROUND

An electrical connector that includes a plate-like male contact and a female contact is used, for example, to extract electricity to outside, as described in JP 6-86268 U. The female contact includes a pair of elastic arms that sandwich the male contact from top and bottom surfaces.

Typically, in the electrical connector of this kind, a front end of the male contact to be inserted into the female contact first is processed in a tapered shape in order to suppress abrasion of the contact point of the female contact caused by burrs of a front end edge of the male contact. When a plate thickness of the male contact is thin, for example, about 1 mm, however, it is difficult to perform the taper processing. To suppress abrasion when the male contact comes into contact with the contact point of the female contact, it is sufficient to weaken force of the female contact sandwiching the male contact to reduce a contact load. When the contact load is small, however, it is not possible to realize stable electrical connection, for example, under an environment in which vibration is applied.

SUMMARY

A female contact, constructed in accordance with the present invention, has a first elastic arm and a second elastic arm connected to the first elastic arm. The first elastic arm extends from a rear end side toward a front end side and has a first dummy contact point on the front end side and a first actual contact point rearward of the first dummy contact point that has a smaller protrusion than the first dummy contact point. The second elastic arm extends from a rear end side toward a front end side and has a second dummy contact point on the front end side and a second actual contact point rearward of the second dummy contact point that has a smaller protrusion than the second dummy contact point.

A mating structure, constructed in accordance with the present invention, includes the female contact defined above and a plate-like male contact that is sandwiched between the first elastic arm and the second elastic arm and includes an engagement portion with which the first dummy contact point and the second dummy contact point of the female contact are engaged in a state where the male contact is completely mated with the female contact.

DETAILED DESCRIPTION OF THE EMBODIMENT(S)

An embodiment of the present invention is described below with reference to accompanying drawings.

Figure 1A:
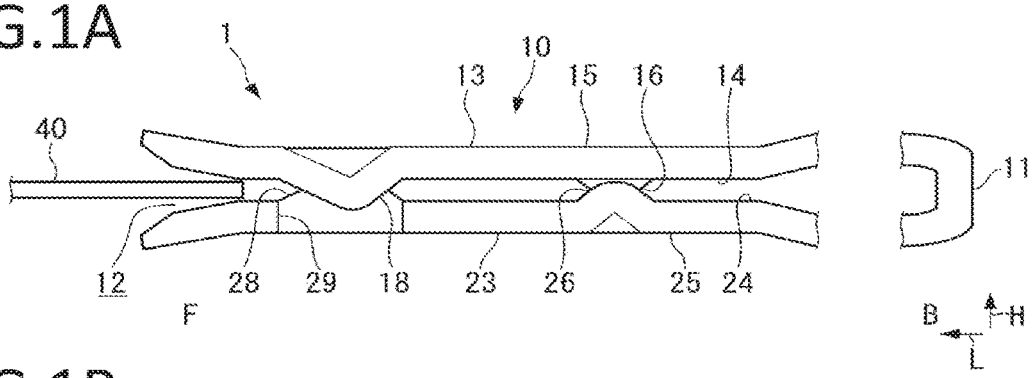
FIGS. 1A, 1B, and 1C each illustrate a female contact according to an embodiment of the present invention, FIG. 1A being a side view, FIG. 1B being a plan view, and FIG. 1C being a bottom view.
Figure 4A:
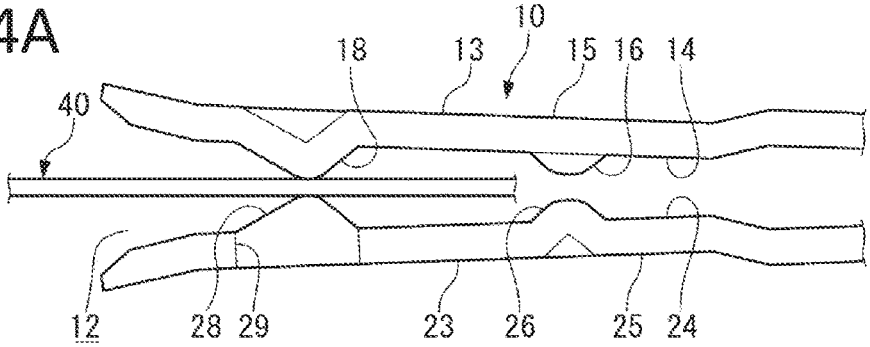
FIGS. 4A, 4B, and 4C are side views each illustrating a mating process of the female contact and the male contact according to the present embodiment.
Figure 4B:
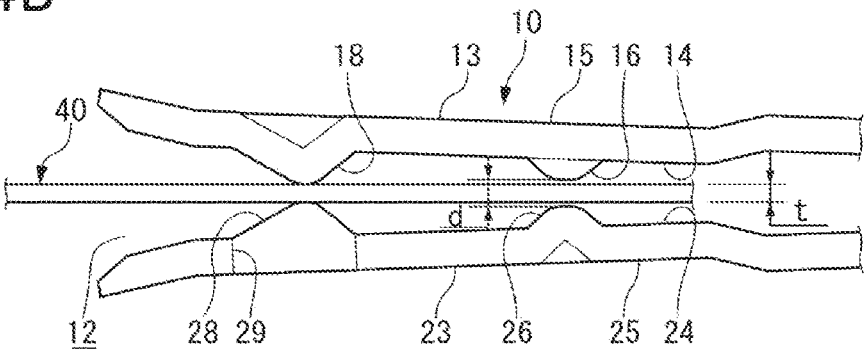
Figure 4C:
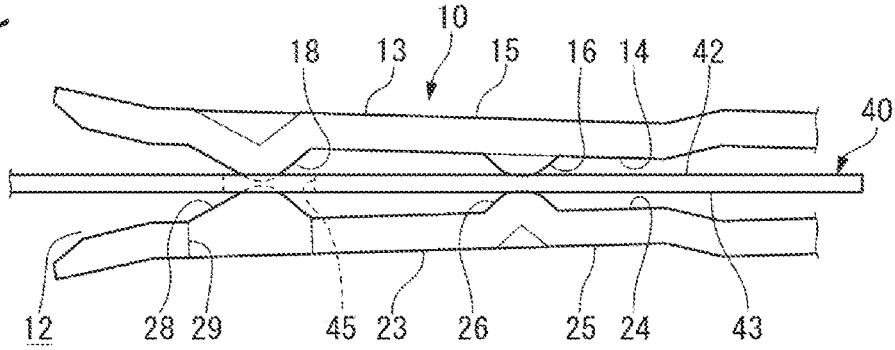

As illustrated in FIG. 1A and FIG. 4C, a mating structure 1 of contacts according to the present embodiment includes a female contact 10 and a plate-like male contact 40 that is sandwiched by the female contact 10. The female contact 10 adopts a new configuration of a dummy contact point, which allows the mating structure 1 to achieve action and effects of suppressing abrasion of the contact point of the female contact 10 and securing a sufficient contact load with respect to the male contact 40 even in a case of the male contact 40 having a small plate thickness.

In the following, configurations of the mating structure 1, the female contact 10, and the male contact 40 are described in order and then the action and the effects of the mating structure 1 are described.

As illustrated in FIG. 1A and FIG. 4C, in the mating structure 1, the male contact 40 is sandwiched at top and bottom surfaces by the female contact 10, which results in electrical connection of the female contact 10 and the male contact 40. The electrical connection is achieved by contact of a first actual contact point 16 and second actual contact points 26, 26 of the female contact 10 with the male contact 40. The mating structure 1 of the present embodiment is characterized in that the female contact 10 includes first dummy contact points 18, 18 and a second dummy contact point 28, in addition to the first actual contact point 16 and the second actual contact points 26, 26.

Figure 1B:
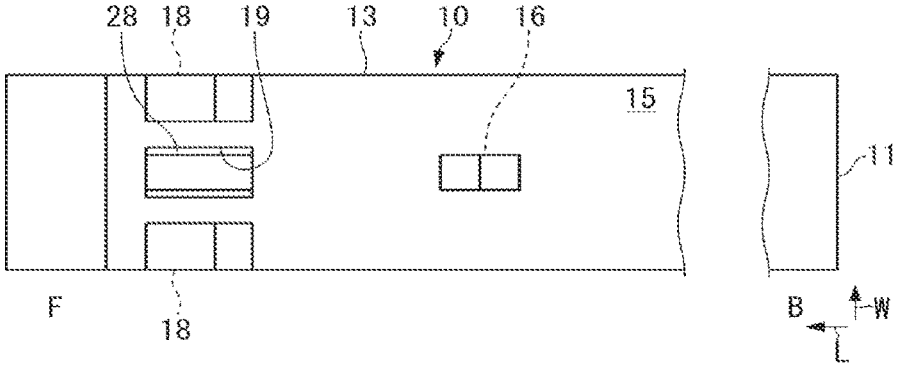
Figure 1C:
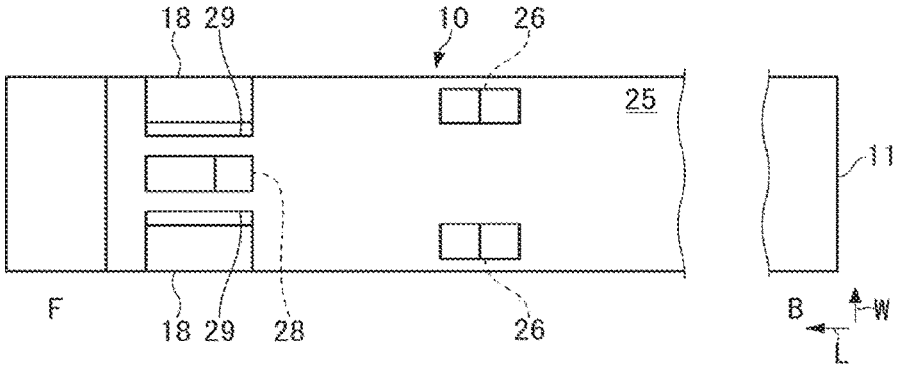

The female contact 10 is integrally formed by folding a plate material at substantially 180 degrees. As illustrated in FIGS. 1A, 1B, and 1C, the female contact 10 includes a connection end 11 on a rear end side and a pair of first elastic arm 13 and second elastic arm 23. The first elastic arm 13 and the second elastic arm 23 each extend from the connection end 11 toward a front end side. The plate material configuring the female contact 10 is made of a metal material excellent in electroconductivity and having high elasticity, such as a copper alloy, and is subjected to surface treatment such as plating treatment as necessary.

The female contact 10 has spring property based on elasticity of each of the connection end 11, the first elastic arm 13, and the second elastic arm 23, and uses the spring property to sandwich the male contact 40 with a predetermined contact load.

The female contact 10 has a mating opening 12 that is provided between the first elastic arm 13 and the second elastic arm 23 on the front end side and the mating male contact 40 is pushed in between the first elastic arm 13 and the second elastic arm 23 from the mating opening 12.

Note that the following description is given while a side receiving the male contact 40 is defined as front (F) and an opposite side on which the connection end 11 is provided is defined as rear (B) in the female contact 10. The front (F) and the rear (B) have relative relationship.

Further, in the female contact 10, a front-rear direction L, a width direction W, and a height direction H are defined as illustrated in FIGS. 1A, 1B, and 1C. The front-rear direction L, the width direction W, and the height direction H are orthogonal to one another.

As illustrated in FIGS. 1A, 1B, and 1C and FIGS. 2A, 2B, and 2C, the first elastic arm 13 and the second elastic arm 23 are substantially parallel to each other from the rear end side connected to the connection end 11 toward the front end side. The first elastic arm 13 includes an inner surface 14 facing the second elastic arm 23, and an outer surface 15 on a rear side of the inner surface 14. In addition, the second elastic arm 23 includes an inner surface 24 facing the first elastic arm 13, and an outer surface 25 on a rear side of the inner surface 24.

As illustrated in FIGS. 1A, 1B, and 1C and FIGS. 2A, 2B, and 2C, the first elastic arm 13 includes the first actual contact point 16 and the first dummy contact points 18, 18 on the inner surface 14.

The first actual contact point 16 and the first dummy contact points 18, 18 are formed integrally with the first elastic arm 13 through press processing in which a load is applied from the outer surface 15 toward the inner surface 14. The second actual contact points 26, 26 and the second dummy contact point 28 are formed in a similar manner.

The first actual contact point 16 is a part of electrically connecting the female contact 10 and the male contact 40 in a mating completion state where mating operation of the female contact 10 and the male contact 40 has been completed. Necessary power or an electrical signal flows between the female contact 10 and the male contact 40 through the first actual contact point 16.

Further, the first dummy contact points 18, 18 come into contact with the male contact 40 from the start to immediately before completion of the mating operation of the female contact 10 and the male contact 40. The first actual contact point 16 does not come into contact with the male contact 40 while the first dummy contact points 18, 18 are in contact with the male contact 40. In contrast, when the first actual contact point 16 comes into contact with the male contact 40, the contact of the first dummy contact points 18, 18 and the male contact 40 is released. As described above, the first dummy contact points 18, 18 do not perform electrical connection of the female contact 10 and the male contact 40 in the mating completion state.

As illustrated in FIG. 1A, the first dummy contact points 18, 18 are on a side nearer the front end than (forward of) the first actual contact point 16. When the male contact 40 is inserted between the first elastic arm 13 and the second elastic arm 23, the male contact 40 comes into contact with the first dummy contact points 18, 18 before the first actual contact point 16.

When the first actual contact point 16 and the first dummy contact points 18, 18 are compared, the first actual contact point 16 has a smaller protrusion from the inner surface 14 toward the second elastic arm 23 than the first dummy contact points 18, 18.

The first actual contact point 16 is only at one position, at a center of the female contact 10 in the width direction W. In addition, the two first dummy contact points 18, 18 are at symmetrical positions in the width direction W with a gap in the width direction W. Note that the number and the arrangement of the first actual contact point 16 and the first dummy contact point 18 are optional and one or a plurality of first actual contact points 16 and one or a plurality of first dummy contact points 18, 18 may be provided. The second actual contact point 26 and the second dummy contact point 28 may be similarly provided.

As illustrated in FIG. 1B, the first elastic arm 13 includes a first engagement portion 19 between the two first dummy contact points 18, 18 in the width direction W. The first engagement portion 19 penetrates through the top and bottom surfaces of the first elastic arm 13. When the first engagement portion 19 is provided, a front end of the second dummy contact point 28 enters and is engaged with the first engagement portion 19, which makes it possible to reduce the gap between the first elastic arm 13 and the second elastic arm 23. Note that this is based on the premise that no load is applied to the female contact 10.

Next, the second elastic arm 23 includes the second actual contact points 26, 26 and the second dummy contact point 28 on the inner surface 24 as illustrated in FIGS. 1A, 1B, and 1C and FIGS. 2A, 2B, and 2C.

The second actual contact points 26, 26 are parts of electrically connecting the female contact 10 and the male contact 40 in the mating completion state where the mating operation of the female contact 10 and the male contact 40 has been completed. Necessary power or an electrical signal flows between the female contact 10 and the male contact 40 through the second actual contact points 26, 26.

Further, the second dummy contact point 28 is a part coming into contact with the male contact 40 from start to immediately before completion of the mating operation of the female contact 10 and the male contact 40. The second actual contact points 26, 26 do not come into contact with the male contact 40 while the second dummy contact point 28 is in contact with the male contact 40. In contrast, when the second actual contact points 26, 26 come into contact with the male contact 40, the contact of the second dummy contact point 28 and the male contact 40 is released. As described above, the second dummy contact point 28 does not electrically connect the female contact 10 and the male contact 40 in the mating completion state, as with the first dummy contact points 18, 18.

As illustrated in FIG. 1A, the second dummy contact point 28 is on the front end side of the second actual contact points 26, 26. When the male contact 40 is inserted between the first elastic arm 13 and the second elastic arm 23, the male contact 40 comes into contact with the second dummy contact point 28 before the second actual contact points 26, 26.

When the second actual contact points 26, 26 and the second dummy contact point 28 are compared, each of the second actual contact points 26, 26 has a smaller protrusion from the inner surface 24 toward the first elastic arm 13 than the second dummy contact point 28.

The two second actual contact points 26, 26 are at symmetrical positions in the width direction W with a gap in the width direction W of the female contact 10. Further, the second dummy contact point 28 is at the center in the width direction W.

The protrusion of each of the second actual contact points 26, 26 from the inner surface 24 is equal to the protrusion of the first actual contact point 16 from the inner surface 14. Further, the protrusion of the second dummy contact point 28 from the inner surface 24 is equal to the protrusion of each of the first dummy contact points 18, 18 from the inner surface 14.

As illustrated in FIG. 1C, the second elastic arm 23 includes second engagement portions 29 on both sides of the second dummy contact point 28 in the width direction W. Each of the second engagement portions 19 penetrates through the top and bottom surfaces of the second elastic arm 23. When the second engagement portions 29 are provided, front ends of the first dummy contact points 18, 18 are, respectively, engaged with the second engagement portions 29, which makes it possible to reduce the gap between the first elastic arm 13 and the second elastic arm 23, together with the first engagement portion 19.

Next, arrangement of the first actual contact point 16, the second actual contact points 26, 26, the first dummy contact points 18, 18, and the second dummy contact point 28 is described with reference to FIGS. 1A, 1B, and 1C and FIGS. 2A, 2B, and 2C.

The first actual contact point 16 and the second actual contact points 26, 26 are at positions different from one another in the width direction W. The first dummy contact points 18, 18 and the second dummy contact point 28 are at positions different from one another in the width direction W. Accordingly, mutual interference between the first actual contact point 16 and the second actual contact points 26, 26 is avoided and mutual interference between the first dummy contact points 18, 18 and the second dummy contact point 28 is avoided.

Figure 2A:
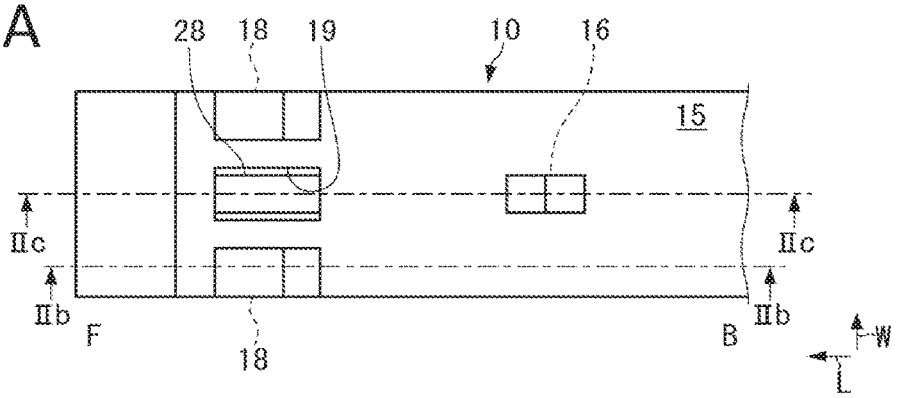
FIGS. 2A, 2B, and 2C each illustrate the female contact of FIGS. 1A, 1B, and 1C, FIG. 2A being a plan view, FIG. 2B being a cross-sectional view taken along a line IIb-IIb of FIG. 2A, and FIG. 2C being a cross-sectional view taken along a line IIc-IIc of FIG. 2A.
Figure 2B:
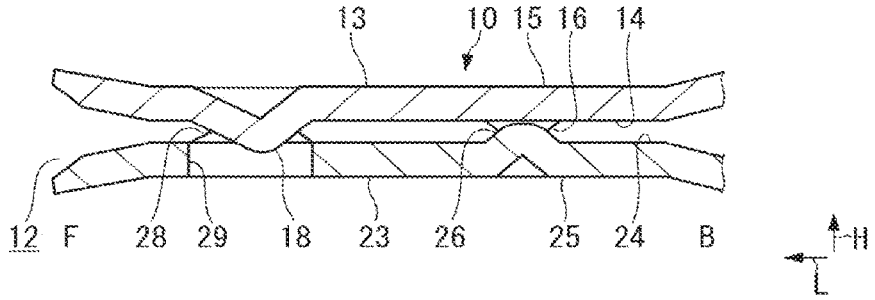
Figure 2C:
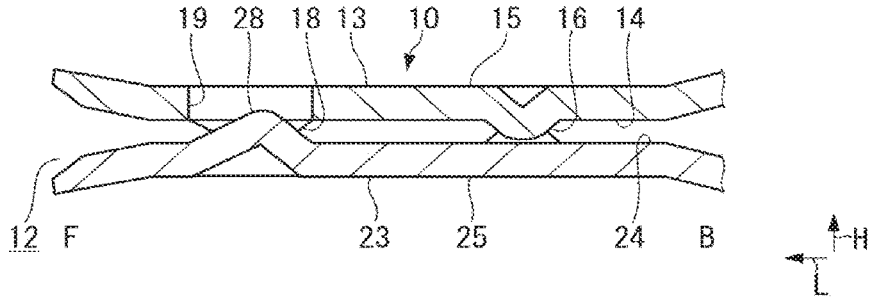

In particular, as illustrated in FIG. 1A and FIGS. 2B and 2C, the first actual contact point 16 and the second actual contact points 26, 26 of the female contact 10 cross with one another in the height direction H and the first dummy contact points 18, 18 and the second dummy contact point 28 also cross with one another in the height direction H. This makes it possible to reduce the gap between the first elastic arm 13 and the second elastic arm 23. Note that the cross used herein indicates that the first actual contact point 16 and the second actual contact points 26, 26 are overlapped with each other and the first dummy contact points 18, 18 and the second dummy contact point 28 are overlapped with each other when the female contact 10 is viewed from the side.

In addition, the first elastic arm 13 includes the first engagement portion 19 as well as the second elastic arm 23 includes the second engagement portions 29. The first dummy contact points 18, 18, respectively, enter the second engagement portions 29 and the front end of the second dummy contact point 28 is engaged with the first engagement portion 19. Accordingly, it is possible to further reduce the gap between the first elastic arm 13 and the second elastic arm 23.

Moreover, the first dummy contact points 18, 18 and the second dummy contact point 28 are disposed at the symmetrical positions in the width direction W and the first actual contact point 16 and the second actual contact points 26, 26 are at the symmetrical positions in the width direction W.

Furthermore, the first dummy contact points 18, 18 and the second dummy contact point 28 are at the same position in the front-rear direction L.

Figure 3A:
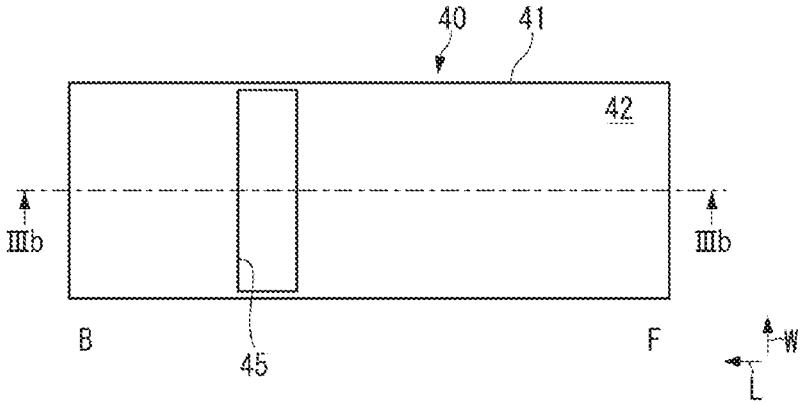
FIGS. 3A, 3B, and 3C each illustrate a male contact according to the embodiment of the present invention, FIG. 3A being a plan view, FIG. 3B being a cross-sectional view taken along a line IIIb-IIIb of FIG. 3A, and FIG. 3C being a plan view of a male contact according to a modification.
Figure 3B:
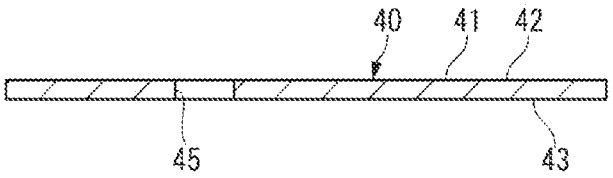
Figure 3C:
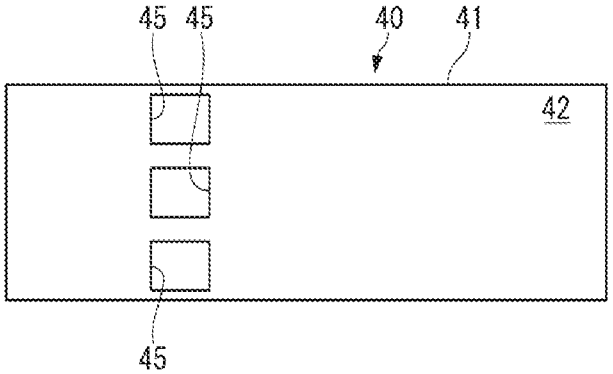

Next, as illustrated in FIGS. 3A, 3B, and 3C, the male contact 40 is a flat plate-like member having a rectangular planar shape. The male contact 40 is made of a metal material similar to that of the female contact 10; however, the male contact 40 may be made of a metal material having low elasticity. A plate thickness of the male contact 40 is selected within the range of 1 mm or less and is preferably 0.5 mm or less, more preferably 0.2 mm or less, and most preferably 0.1 mm or less within the range. The first actual contact point 16 and the second actual contact points 26, 26 of the female contact 10 come into contact with a top surface 42 and a bottom surface 43 of the male contact 40, which results in electrical connection with the female contact 10.

In the male contact 40, the following description is given while a side to be inserted into the female contact 10 is defined as front (F) and an opposite side is defined as rear (B). The front (F) and the rear (B) have relative relationship.

In addition, in the male contact 40, the width direction W and the front-rear direction L are defined as illustrated in FIGS. 3A, 3B, and 3C.

As illustrated in FIGS. 3A and 3B, the male contact 40 includes a main body 41 made of a metal material and a third engagement portion 45 that penetrates through the top and bottom surfaces of the main body 41.

When the male contact 40 is pushed into a position completely mated with the female contact 10 and is put into the mating completion state, the first dummy contact points 18, 18 of the first elastic arm 13 are engaged with the third engagement portion 45 from the top surface 42 toward the bottom surface 43 of the main body 41 and the second dummy contact point 28 of the second elastic arm 23 is engaged with the third engagement portion 45 from the bottom surface 43 toward the top surface 42 of the main body 41. The third engagement portion 45 is in the region of the front-rear direction L with which the first dummy contact points 18, 18 and the second dummy contact point 28 are engaged, in the state where the female contact 10 and the male contact 40 have been completely mated with each other.

Note that the top surface 42 and the bottom surface 43 of the main body 41 are not uniquely defined. In the present embodiment, for convenience, the surface facing the first elastic arm 13 is referred to as the top surface 42 and the surface facing the second elastic arm 23 is referred to as the bottom surface 43.

As described above, the third engagement portion 45 is in the region corresponding to the first dummy contact points 18, 18 and the second dummy contact point 28 in the state where the female contact 10 and the male contact 40 have been completely mated with each other. The third engagement portion 45 may be in an extended wide region including the corresponding region as illustrated in FIGS. 3A and 3B, or a plurality of, for example, three third engagement portions 45 may be in limited regions, respectively, corresponding to the first dummy contact points 18, 18 and the second dummy contact point 28 as illustrated in FIG. 3C.

The male contact 40 includes burrs that are formed at a peripheral edge including a front end because the male contact 40 is fabricated by stamping the plate material. On the other hand, the burrs remain in the peripheral edge because the male contact 40 has a small thickness and, thus, it is difficult to perform taper processing on the front end. The burrs may come into contact with the first actual contact point 16 and the second actual contact points 26, 26 of the female contact 10 to abnormally abrade the first actual contact point 16 and the second actual contact points 26, 26 when the male contact 40 is mated with the female contact 10. In the mating structure 1 according to the present embodiment, however, it is possible to prevent the front end of the male contact 40 from coming into contact with the first actual contact point 16 and the second actual contact points 26, 26 when the front end of the male contact 40 passes through the first actual contact point 16 and the second actual contact points 26, 26.

Next, a procedure of mating the female contact 10 and the male contact 40 with each other is described with reference to FIG. 1A and FIG. 4C.

First, as illustrated in FIG. 1A, the male contact 40 is positioned with respect to the mating opening 12 that has on the front end side of the first elastic arm 13 and the second elastic arm 23, and the male contact 40 is then pushed into the female contact 10.

When the male contact 40 is inserted between the first dummy contact points 18, 18 and the second dummy contact point 28 as illustrated in FIG. 4C, the mutual gap between the first elastic arm 13 and the second elastic arm 23 is expanded. At this time, the first dummy contact points 18, 18 and the second dummy contact point 28 come into contact with the male contact 40 and a distance d between the first actual contact point 16 and the second actual contact points 26, 26 exceeds a thickness t of the male contact 40 as illustrated in FIG. 4B.

When the male contact 40 is pushed in toward the mating completion position, the male contact 40 passes between the first actual contact point 16 of the first elastic arm 13 and the second actual contact points 26, 26 of the second elastic arm 23 as illustrated in FIG. 4B. The distance d still exceeds the thickness t even when the male contact 40 is pushed in because the male contact 40 has the constant thickness. Therefore, the front end of the male contact 40 does not come into contact with and is apart from the first actual contact point 16 and the second actual contact points 26, 26 when the front end passes between the first actual contact point 16 and the second actual contact points 26, 26. Accordingly, even if the burrs remain at the front end of the male contact 40, the front end having the burrs does not come into contact with and abrade the first actual contact point 16 and the second actual contact points 26, 26.

When the male contact 40 is pushed into the mating completion position, the first dummy contact points 18, 18 of the first elastic arm 13 and the second dummy contact point 28 of the second elastic arm 23 are inserted into the third engagement portion 45 of the male contact 40 as illustrated in FIG. 4C. As a result, the first elastic arm 13 and the second elastic arm 23 are released from support by the male contact 40 and are elastically returned to reduce the gap between the first elastic arm 13 and the second elastic arm 23 that has been pushingly expanded. Accordingly, the first actual contact point 16 and the second actual contact points 26, 26, respectively, come into contact with the top surface 42 and the bottom surface 43 of the male contact 40 and the contact load resistant to vibration is applied to the male contact 40 through the first actual contact point 16 and the second actual contact points 26, 26.

Action and effects achieved by the present embodiment are described below.

In the mating structure 1 according to the present embodiment, when the front end of the male contact 40 passes through the first actual contact point 16 and the second actual contact points 26, 26 and the mating completion state is established, the first actual contact point 16 and the second actual contact points 26, 26 come into contact with the male contact 40. Accordingly, the mating structure 1 makes it possible to prevent the front end of the male contact 40 from coming into contact with the first actual contact point 16 and the second actual contact points 26, 26 even in the case of the thin male contact 40, the front end of which is difficult to be subjected to taper processing. This prevents abnormal abrasion of the first actual contact point 16 and the second actual contact points 26, 26.

Further, with the mating structure 1, it is unnecessary to consider abrasion due to the contact of the front end of the male contact 40 with the first actual contact point 16 and the second actual contact points 26, 26. This makes it possible to secure high contact load by the first elastic arm 13 and the second elastic arm 23 and to achieve stable electrical connection of the female contact 10 and the male contact 40.

Next, the mating structure 1 according to the present embodiment includes the plurality of first dummy contact points 18, 18 and the second dummy contact point 28 in the width direction W. Therefore, it is possible to mate the male contact 40 with the female contact 10 while stabilizing the attitude of the male contact 40 in the mating process of the female contact 10 and the male contact 40. In particular, in the present embodiment, the first dummy contact points 18, 18 and the second dummy contact point 28 are disposed symmetrically in the width direction W, which makes it possible to further stabilize the attitude of the male contact 40 in the mating process.

Moreover, the mating structure 1 of the present embodiment includes the first actual contact point 16 and the plurality of second actual contact points 26, 26 and the first actual contact point 16 and the second actual contact points 26, 26 are disposed at the symmetrical positions in the width direction W. Therefore, it is possible to balance the force holding the male contact 40 in the width direction W. As a result, the mating structure 1 makes it possible to bring an amplitude when receiving vibration, close to uniform in the width direction W, thereby achieving high vibration resistance.

Furthermore, in the female contact 10 according to the present embodiment, it is possible to reduce the gap between the first elastic arm 13 and the second elastic arm 23 in an unloaded state by providing the first actual contact point 16 and the second actual contact points 26, 26 at the positions different from one another in the width direction W and providing the first dummy contact points 18, 18 and the second dummy contact point 28 at the positions different from one another in the width direction W, etc. When the male contact 40 is mated with the female contact 10, it is possible to increase the expanded dimension of the first elastic arm 13 and the second elastic arm 23. This makes it possible to increase elastic force occurred on the female contact 10. Accordingly, the female contact 10 makes it possible to increase the contact load that is applied to the male contact 40 through the first actual contact point 16 and the second actual contact points 26, 26.

In addition, in the female contact 10 according to the present invention, the first dummy contact points 18, 18 and the second dummy contact point 28 cross with one another in the height direction. Therefore, when the male contact 40 is inserted between the first dummy contact points 18, 18 and the second dummy contact point 28, the male contact 40 pushingly expands the gap between the first elastic arm 13 and the second elastic arm 23. This is advantageous to reliably separate the first actual contact point 16 and the second actual contact points 26, 26 from the male contact 40 until immediately before mating completion.

Although the preferred embodiment of the present invention has been described hereinbefore, the configurations described in the above-described embodiment may be selected or may be appropriately modified without departing from the scope of the present invention.

Figure 5A:
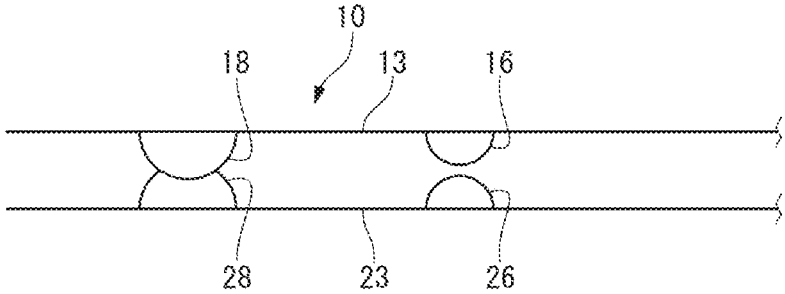
FIGS. 5A, 5B, 5C, and 5D illustrate modifications of the female contact of the present embodiment, FIG. 5A illustrating the present embodiment in a simplified manner, and FIGS. 5B, and 5D illustrating the modifications.

As schematically illustrated in FIG. 5A, in the mating structure 1 according to the present embodiment, the example in which the protrusion of each of the first dummy contact points 18, 18 and the second dummy contact point 28 is larger than the protrusion of each of the first actual contact point 16 and the second actual contact points 26, 26 has been described, based on the premise that the first elastic arm 13 and the second elastic arm 23 are wholly parallel to each other. The present invention, however, is not limited to the configuration.

Figure 5B:
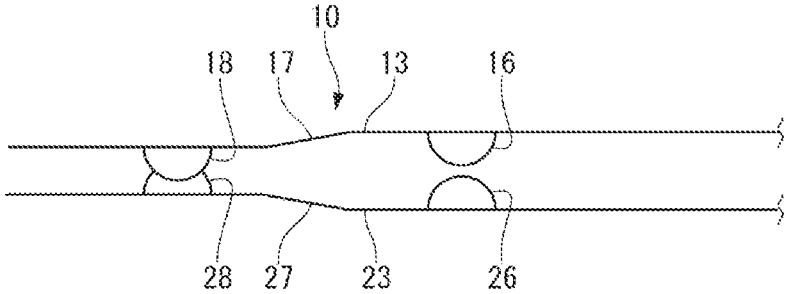

For example, as illustrated in FIG. 5B, when inclination parts 17 and 27 that are mutually close to each other are, respectively, in the first elastic arm 13 and the second elastic arm 23, it is possible to make the protrusion of each of the first dummy contact points 18, 18 and the second dummy contact point 28 equivalent to or lower than the protrusion of each of the first actual contact point 16 and the second actual contact points 26, 26. In other words, the protrusion in the present invention is specified at a position of a top of each of the first actual contact point 16, the second actual contact points 26, 26, the first dummy contact points 18, 18, and the second dummy contact point 28, in the unloaded state where the male contact 40 is not mated with the female contact 10.

Processing is easily performed in the case where the first elastic arm 13 and the second elastic arm 23 are parallel to each other, as compared with the case of providing the inclination parts 17 and 27.

Figure 5C:
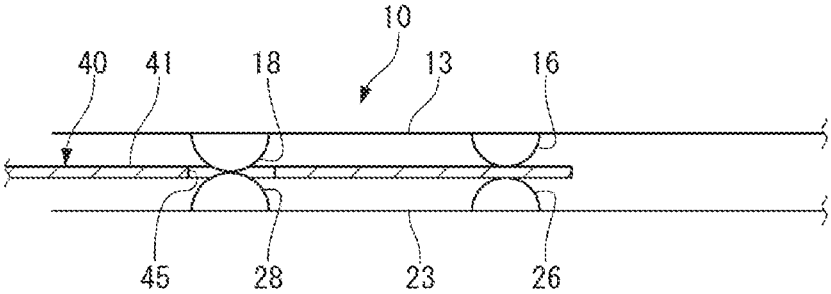

Moreover, as illustrated in FIGS. 1A, 1B, and 1C and FIGS. 2A, 2B, and 2C, in the mating structure 1 according to the present embodiment, the first dummy contact points 18, 18 and the second dummy contact point 28 are disposed at the different positions that are shifted from one another in the width direction W; however, the present invention is not limited thereto. For example, as illustrated in FIG. 5C, the first dummy contact points 18, 18 and the second dummy contact point 28 may be provided at the same position in the width direction W. The first actual contact point 16 and the second actual contact points 26, 26 may be similarly provided.

Figure 5D:
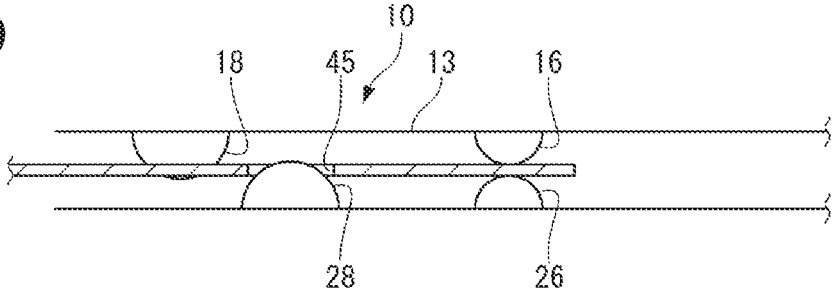

Further, in the mating structure 1 according to the present embodiment, the first dummy contact points 18, 18 and the second dummy contact point 28 are at the same position in the front-rear direction L; however, the present invention is not limited thereto. For example, as illustrated in FIG. 5D, the first dummy contact points 18, 18 of the first elastic arm 13 and the second dummy contact point 28 of the second elastic arm 23 may be disposed at different positions that are shifted from one another in the front-rear direction L.

Figure 6A:
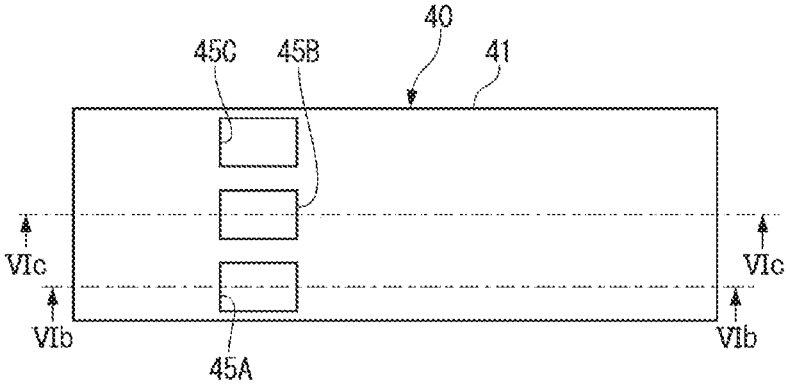
FIGS. 6A, 6B, and 6C each illustrate a modification of the male contact of the present embodiment, FIG. 6A being a plan view, FIG. 6B being a cross-sectional view taken along a line VIb-VIb of FIG. 6A, and FIG. 6C being a cross-sectional view taken along a line VIc-VIc of FIG. 6A.
Figure 6B:
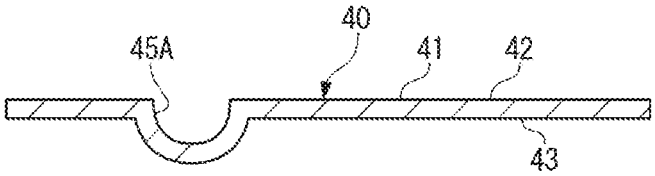
Figure 6C:
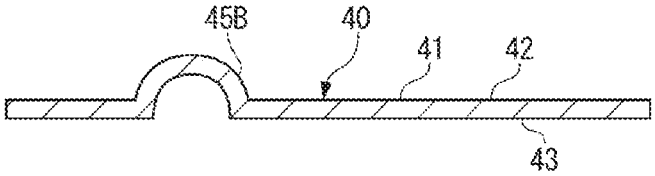

Furthermore, in the mating structure 1 according to the present embodiment, the example in which, in the mating completion state, the first dummy contact points 18, 18 and the second dummy contact point 28 are engaged with the third engagement portion 45 that penetrates through the top and bottom surfaces of the main body 41 has been described; however, the present invention is not limited thereto. For example, as illustrated in FIGS. 6A, 6B, and 6C, third engagement portions 45A, 45B, and 45C each having a bottom may be provided in the main body 41. The third engagement portions 45A and 45C, respectively, correspond to the first dummy contact points 18, 18 of the first elastic arm 13 and are recessed from the top surface 42 toward the bottom surface 43 of the main body 41. The third engagement portion 45B corresponds to the second dummy contact point 28 of the second elastic arm 23 and is recessed from the bottom surface 43 toward the top surface 42 of the main body 41. When the female contact 10 and the male contact 40 are completely mated with each other, the first dummy contact points 18, 18 of the first elastic arm 13 are, respectively, engaged with the third engagement portions 45A and 45C and the second dummy contact point 28 of the second elastic arm 23 is engaged with the third engagement portion 45B.

Note that the first elastic arm 13 and the second elastic arm 23 in the present embodiment are coupled to each other at the respective rear ends; however, the two arms 13 and 23 may be coupled to each other at the respective sides.

What is claimed is:

1. A female contact comprising:

a first elastic arm extending from a rear end side toward a front end side and including:

(a) a first dummy contact point on the front end side, and (b) a first actual contact point rearward of the first dummy contact point and having a smaller protrusion than the first dummy contact point; and a second elastic arm extending from a rear end side toward a front end side, connected to the first elastic arm, and including:

(a) a second dummy contact point on the front end side, and (b) a second actual contact point rearward of the second dummy contact point and having a smaller protrusion than the second dummy contact point.

2. The female contact according to claim 1, wherein:

(a) the first dummy contact point on the first elastic arm and the second dummy contact point on the second elastic arm are at positions different from each other in a width direction that is orthogonal to a front-rear direction, and (b) the first actual contact point on the first elastic arm and the second actual contact point on the second elastic arm are at positions different from each other in the width direction.

3. The female contact according to claim 2, wherein:

(a) the first dummy contact point and the second dummy contact point cross with each other in a height direction in which the first elastic arm and the second elastic arm face each other, and (b) the first actual contact point and the second actual contact point cross with each other in the height direction.

4. The female contact according to claim 3, wherein:

(a) the first elastic arm includes a first engagement portion with which the second dummy contact point is engaged, and (b) the second elastic arm includes a second engagement portion with which the first dummy contact point is engaged.

5. The female contact according to claim 1, wherein:

(a) the first dummy contact point and the second dummy contact point are disposed symmetrically in a width direction that is orthogonal to a front-rear direction, and (b) the first actual contact point and the second actual contact point are disposed symmetrically in the width direction.

6. The female contact according to claim 1, wherein the first dummy contact point and the second dummy contact point are at a same position in a front-rear direction.

7. The female contact according to claim 1, wherein:

(a) the first elastic arm and the second elastic arm are parallel to each other, (b) the first dummy contact point has a larger protrusion from the first elastic arm than the first actual contact point, and (c) the second dummy contact point has a larger protrusion from the second elastic arm than the second actual contact point.

8. A mating structure of contacts comprising:

a female contact comprising:

(a) a first elastic arm extending from a rear end side toward a front end side and including:

(1) a first dummy contact point on the front end side, and (2) a first actual contact point rearward of the first dummy contact point and having a smaller protrusion than the first dummy contact point; and (b) a second elastic arm extending from a rear end side toward a front end side, connected to the first elastic arm, and including:

(1) a second dummy contact point on the front end side, and (2) a second actual contact point rearward of the second dummy contact point and having a smaller protrusion than the second dummy contact point; and a male contact that is sandwiched between the first elastic arm and the second elastic arm and has an engagement portion with which the first dummy contact point and the second dummy contact point of the female contact are engaged in a state where the male contact is mated with the female contact.

9. The mating structure of contacts according to claim 8, wherein:

(a) the first dummy contact point on the first elastic arm and the second dummy contact point on the second elastic arm are provided at positions different from each other in a width direction that is orthogonal to a front-rear direction, and (b) the first actual contact point provided on the first elastic arm and the second actual contact point provided on the second elastic arm are provided at positions different from each other in the width direction.

10. The mating structure of contacts according to claim 9, wherein:

(a) the first dummy contact point and the second dummy contact point cross with each other in a height direction in which the first elastic arm and the second elastic arm face each other, and (b) the first actual contact point and the second actual contact point cross with each other in the height direction.

11. The mating structure of contacts according to claim 8, wherein the male contact is a plate.

12. The mating structure of contacts according to claim 11, wherein:

(a) the first dummy contact point on the first elastic arm and the second dummy contact point on the second elastic arm are at positions different from each other in a width direction that is orthogonal to a front-rear direction, and (b) the first actual contact point on the first elastic arm and the second actual contact point on the second elastic arm are at positions different from each other in the width direction.

13. The mating structure of contacts according to claim 12, wherein:

(a) the first dummy contact point and the second dummy contact point cross with each other in a height direction in which the first elastic arm and the second elastic arm face each other, and (b) the first actual contact point and the second actual contact point cross with each other in the height direction.

14. The mating structure of contacts according to claim 13, wherein:

(a) the first elastic arm includes a first engagement portion with which the second dummy contact point is engaged, and (b) the second elastic arm includes a second engagement portion with which the first dummy contact point is engaged.

15. The mating structure of contacts according to claim 8, wherein:

(a) the first dummy contact point and the second dummy contact point are disposed symmetrically in a width direction that is orthogonal to a front-rear direction, and (b) the first actual contact point and the second actual contact point are disposed symmetrically in the width direction.

16. The mating structure of contacts according to claim 8, wherein the first dummy contact point and the second dummy contact point are at a same position in a front-rear direction.

17. The mating structure of contacts according to claim 8, wherein:

(a) the first elastic arm and the second elastic arm are parallel to each other, (b) the first dummy contact point has a larger protrusion from the first elastic arm than the first actual contact point, and (c) the second dummy contact point has a larger protrusion from the second elastic arm than the second actual contact point.

18. The female contact according to claim 1, wherein the first dummy contact point does not contact a male contact matable with the female contact while the first actual contact point is in contact with the male contact.

19. The mating structure of contacts according to claim 8, wherein the first actual contact point does not contact the male contact while the first dummy contact point is in contact with the male contact.

20. The mating structure of contacts according to claim 8, wherein the first dummy contact point does not contact the male contact and the first actual contact point is in contact with the male contact in the state where the male contact is mated with the female contact.

* * * * *